US011230110B2

(12) United States Patent
Fukasawa et al.

(10) Patent No.: US 11,230,110 B2
(45) Date of Patent: Jan. 25, 2022

(54) INK ACCOMMODATION DEVICE

(71) Applicant: SEIKO EPSON CORPORATION, Tokyo (JP)

(72) Inventors: Koki Fukasawa, Shiojiri (JP); Shugo Hattori, Shiojiri (JP); Shinji Hirata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/988,062

(22) Filed: Aug. 7, 2020

(65) Prior Publication Data

US 2021/0039396 A1 Feb. 11, 2021

(30) Foreign Application Priority Data

Aug. 9, 2019 (JP) ..... JP2019-147226

(51) Int. Cl.
*B41J 2/175* (2006.01)
*B41J 29/13* (2006.01)

(52) U.S. Cl.
CPC ..... *B41J 2/1754* (2013.01); *B41J 2/1752* (2013.01); *B41J 2/17509* (2013.01); *B41J 2/17553* (2013.01); *B41J 2/17559* (2013.01); *B41J 29/13* (2013.01)

(58) Field of Classification Search
CPC .... B41J 2/175; B41J 2/17506; B41J 2/17509; B41J 2/17513; B41J 2/1752; B41J 2/1754; B41J 2/17553; B41J 2/17559; B41J 29/13; B41J 29/38
See application file for complete search history.

(56) References Cited

U.S. PATENT DOCUMENTS 4,914,453 A * 4/1990 Kanayama ..... B41J 2/175 347/86
9,707,769 B2 * 7/2017 Suzuki ..... B41J 29/13
10,155,392 B2 * 12/2018 Kamiya ..... B41J 2/17506
2008/0297571 A1 * 12/2008 Umeda ..... B41J 2/17513 347/85
2016/0089893 A1 * 3/2016 Osakabe ..... B41J 2/1752 347/85
2018/0311964 A1 11/2018 Tanaka et al.

FOREIGN PATENT DOCUMENTS

JP 2016-132166 A 7/2016
JP 2018-183960 A 11/2018

* cited by examiner

*Primary Examiner* — Anh T Vo
(74) *Attorney, Agent, or Firm* — Workman Nydegger

(57) ABSTRACT

An ink accommodation body capable of accommodating a sublimation transfer ink injected, via an injection port from, a bottle accommodating the sublimation transfer ink, and a first cover having a cap capable of closing the injection port, and movable between a closing position at which the cap closes the injection port and an opening position at which the cap opens the injection port, are included, and the cap can be inserted into and pulled out of the injection port in an opening direction of the injection port when the first cover moves between the closing position and the opening position, and the first cover has a finger-hooking portion enabling insertion and pulling of the cap with a finger.

11 Claims, 4 Drawing Sheets

INK ACCOMMODATION DEVICE

The present application is based on, and claims priority from JP Application Serial Number 2019-147226, filed Aug. 9, 2019, the disclosure of which is hereby incorporated by reference herein in its entirety.

BACKGROUND

1. Technical Field

The present disclosure relates to an ink accommodation device for accommodating ink to be injected from an ink bottle.

2. Related Art

In the past, a cap for sealing an injection port in an ink accommodation device for accommodating ink to be injected from an ink bottle has been known. For example, JP-A-2018-183960 discloses an inkjet recording device including an ink tank for accommodating ink to be injected from an ink bottle, and a cap capable of sealing an injection port of the ink tank.

Incidentally, a sublimation transfer ink contains a color material that is skin irritating. Thus, when treating a sublimation transfer ink, a user often wears a glove. When a user removes the above cap disclosed in JP-A-2018-183960 from the injection port, the user needs to grip the cap. It may be difficult for the user wearing a glove to grip the cap. That is, there was a problem in that operability of injection of the sublimation transfer ink from the bottle into an accommodation body was poor.

SUMMARY

An ink accommodation device for solving the above problem includes an ink accommodation body configured to accommodate a sublimation transfer ink injected, via an injection port, from a bottle accommodating the sublimation transfer ink, and an inner cover having a cap configured to close the injection port and configured to move between a closing position at which the cap closes the injection port and an opening position at which the cap opens the injection port, wherein the cap is configured to be inserted into and pulled out of the injection port in an opening direction of the injection port when the inner cover moves between the closing position and the opening position, and the inner cover has a finger-hooking portion enabling insertion and pulling of the cap with a finger.

With this device, when a user injects the sublimation transfer ink into the accommodation body, since the user does not need to grip the cap, operability for the user to inject the sublimation transfer ink is improved.

An ink accommodation device for solving the above problem includes an ink accommodation body configured to accommodate a sublimation transfer ink injected, via an injection port, from a bottle for accommodating the sublimation transfer ink, and an inner cover having a cap configured to close the injection port and configured to move between a closing position at which the cap closes the injection port and an opening position at which the cap opens the injection port, wherein the cap is configured to be inserted into and pulled out of the injection port in an opening direction of the injection port when the inner cover moves between the closing position and the opening position, and the inner cover has a finger-hooking portion that, in a state in which the inner cover is positioned at the closing position, extends in a direction intersecting the opening direction and includes a surface opposite, at a predetermined distance, to a first surface, which is provided with the injection port, of the ink accommodation body.

With this, a user can insert a finger between the first surface and the surface included in the finger-hooking portion, and press the surface included in the finger-hooking portion, to move the cap to the opening position, thus when injecting the sublimation transfer ink into the ink accommodation body, the user does not need to grip the cap. Thus, operability for the user to inject the sublimation transfer ink is improved.

DESCRIPTION OF EXEMPLARY EMBODIMENTS

An exemplary embodiment of an ink accommodation device will be described below.

Figure 1:
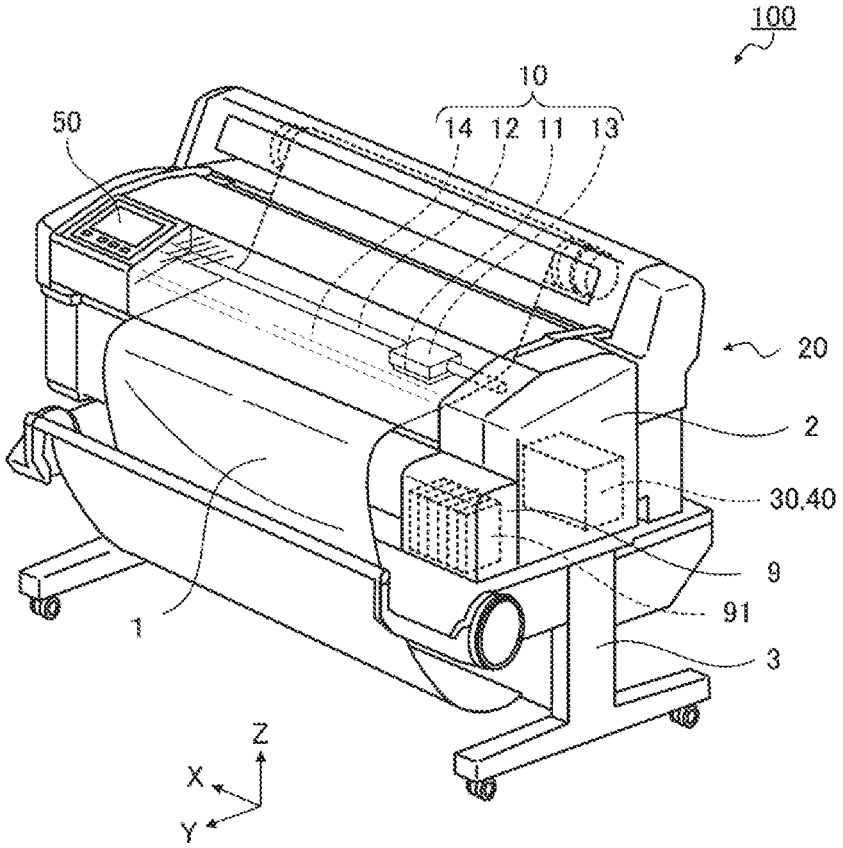
FIG. 1 is a perspective view illustrating an ink accommodation device according to an exemplary embodiment.

As illustrated in FIG. 1, an inkjet printer 100 as an ink accommodation device includes a main body portion 2 and a leg portion 3 that supports the main body portion 2. The main body portion 2 has, as a height, a depth, and a width, respective predetermined lengths. The inkjet printer 100 is to be placed on a horizontal flat surface, and a width direction and a depth direction are substantially horizontal. Then, a vertical direction, the depth direction, and the width direction are indicated using a Z-axis, a Y-axis, and an X-axis intersecting the Z-axis and the Y-axis, respectively. The X-axis, the Z-axis, and the Y-axis are coordinate axes indicating the lengths of the width, height, and depth, respectively.

In the descriptions below, a direction along the X-axis is referred to as the width direction, one direction along the X-axis is referred to as a +X direction, and another direction along the X-axis is referred to as a −X direction. A direction along the Y-axis is referred to as the depth direction, one direction along the Y-axis is referred to as a +Y direction, and another direction along the Y-axis is referred to as a −Y direction. Further, a direction along the Z-axis is referred to as the vertical direction, a vertically downward direction is referred to as a −Z direction, and a vertically upward direction is referred to as a +Z direction.

In the descriptions below, the terms top, bottom, left, right, front, and rear may be used for ease of explanation. Each the direction, when it is assumed that a user is on a side of the +Y direction of the inkjet printer 100, indicates a direction viewed from the user.

The inkjet printer 100 includes a recording unit 10 for recording an image on a medium 1, a transport unit 20 for transporting the medium 1, a storage unit 30, a control unit 40, a display unit 50 for displaying information, and an ink accommodation unit 9 having ink accommodation bodies 91 for accommodating ink. The recording unit 10, the transport unit 20, the storage unit 30, and the control unit 40 are accommodated in the main body portion 2. The display unit 50 is provided on an upper surface of the main body portion 2 and is positioned on a front. The ink accommodation bodies 91 included in the ink accommodation unit 9 are provided on the front of the main body portion 2.

The recording unit 10 includes the recording head 11, a carriage shaft 12, a carriage 13, and a platen 14. The recording head 11 discharges ink onto the medium 1. The carriage shaft 12 extends in the direction along the X-axis. The carriage 13 is supported by the carriage shaft 12 and scans in the direction along the X-axis. The medium 1 is supported by the platen 14. While the carriage 13 on which the recording head 11 is mounted is scanning in the direction along the X-axis, ink is discharged from the recording head 11 onto the medium 1 supported by the platen 14, thus an image is recorded on the medium 1.

The ink accommodated in the ink accommodation body 91 is a sublimation transfer ink for printing on an intermediate transfer medium used for dyeing a dyed thing. In other words, the medium 1 on which an image is recorded by the recording unit 10 is an intermediate transfer medium used for dyeing a dyed thing, and such ink used for printing on an intermediate transfer medium is referred to as a sublimation transfer ink.

The sublimation transfer ink in the present exemplary embodiment is, for example, a yellow ink composition, and contains, as yellow dyes, at least one kind of C.I. Disperse Yellows 3, 4, 5, 7, 9, 13, 23, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 108, 114, 116, 118, 119, 122, 124, 126, 135, 140, 141, 149, 160, 162, 163, 164, 165, 179, 180, 182, 183, 184, 186, 192, 198, 199, 202, 204, 210, 211, 215, 216, 218, 224, 227, 231, and 232. Of these, C.I. Disperse Yellow 54 may be used. By using such a yellow dye, a chromogenic property of a dyed thing tends to improve. A content of a yellow dye may be 1.0 to 4.0 mass %, relative to a total amount of a yellow ink composition, or may be 1.5 to 3.5 mass %, or may be 2.0 to 3.0 mass %. Since the content of the yellow dye falls within the range described above, there is a tendency that while an amount of ink injection is reduced, a sufficient chromogenic property of a dyed thing can be obtained.

The sublimation transfer ink in the present exemplary embodiment is, for example, a magenta ink composition, and contains, as magenta dyes, at least one king of C.I. Disperse Reds 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 266, 277, 278, 279, 281, 288, 298, 302, 303, 310, 311, 312, 320, 324, and 328. Of these, C.I. Disperse Red 60 may be used. By using such a magenta dye, a chromogenic property of a dyed thing tends to improve. A content of a magenta dye may be 4.0 to 8.0 mass %, relative to a total amount of a magenta ink composition, or may be 4.5 to 7.0 mass %, or may be 5.0 to 6.0 mass %. Since the content of the magenta dye falls within the range described above, there is a tendency that while an amount of ink injection is reduced, a sufficient chromogenic property of a dyed thing can be obtained.

The sublimation transfer ink in the present exemplary embodiment is, for example, a cyan ink composition, and contains, as cyan dyes, at least one kind of C.I. Disperse Blues 3, 7, 9, 14, 16, 19, 20, 26, 27, 35, 43, 44, 54, 55, 56, 58, 60, 62, 64, 71, 72, 73, 75, 79, 81, 82, 83, 87, 91, 93, 94, 95, 96, 102, 106, 108, 112, 113, 115, 118, 120, 122, 125, 128, 130, 134, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 266, 267, 268, 270, 284, 285, 287, 288, 291, 293, 295, 297, 301, 315, 330, 333, 359, and 360. Of these, C.I. Disperse Blues 14 and 359 may be used, and C.I. Disperse Blue 359 may be used. By using such a cyan dye, a chromogenic property of a dyed thing tends to improve. A content of a cyan dye may be 3.0 to 7.0 mass %, relative to a total amount of a cyan ink composition, or may be 4.0 to 6.0 mass %, or may be 4.50 to 5.0 mass %. Since the content of the cyan dye falls within the range described above, there is a tendency that while an amount of ink injection is reduced, a sufficient chromogenic property of a dyed thing can be obtained.

The sublimation transfer ink in the present exemplary embodiment is a black ink composition, and contains at least one kind of the above magenta dyes, at least one kind of the above yellow dyes, and at least one kind of the above cyan dyes. A content of the yellow dye may be 0.10 to 1.0 mass %, relative to a total amount of the black ink composition, or may be 0.20 to 0.80 mass %, or may be 0.40 to 0.60 mass %. A content of the magenta dye may be 1.5 to 2.5 mass %, relative to the total amount of the black ink composition, or may be 1.7 to 2.3 mass %, or may be 1.9 to 2.1 mass %. A content of the cyan dye may be 3.75 to 4.75 mass %, relative to the total amount of the black ink composition, or may be 3.5 to 4.5 mass %, or may be 3.8 to 4.2 mass %. Since the content of each of the dyes, that is, the yellow dye, the magenta dye, and the cyan dye, is within the range described above, a black tone property tends to further improve.

Note that, the black ink composition as the sublimation transfer ink in the present exemplary embodiment contains C.I. Disperse Blue 360, and may contain orange dyes such as C.I. Disperse Oranges 1, 3, 5, 7, 11, 13, 17, 20, 21, 25, 29, 30, 31, 32, 33, 37, 38, 42, 43, 44, 45, 46, 47, 48, 49, 50, 53, 54, 55, 56, 57, 58, 59, 61, 66, 71, 73, 76, 78, 80, 89, 90, 91, 93, 96, 97, 119, 127, 130, 139, and 142, or brown dyes such as C.I. Disperse Browns 1, 2, 4, 9, 13, 19, and 27. A content of C.I. Disperse Blue 360 may be 1.00 to 4.00 mass %, relative to the total amount of a second black ink composition, or may be 1.5 to 3.5 mass %, or may be 2.0 to 3.0 mass %. Since the content of C.I. Disperse Blue 360 falls within the range described above, there is a tendency that while an amount of ink injection is reduced, black color density further improves.

Figure 2:
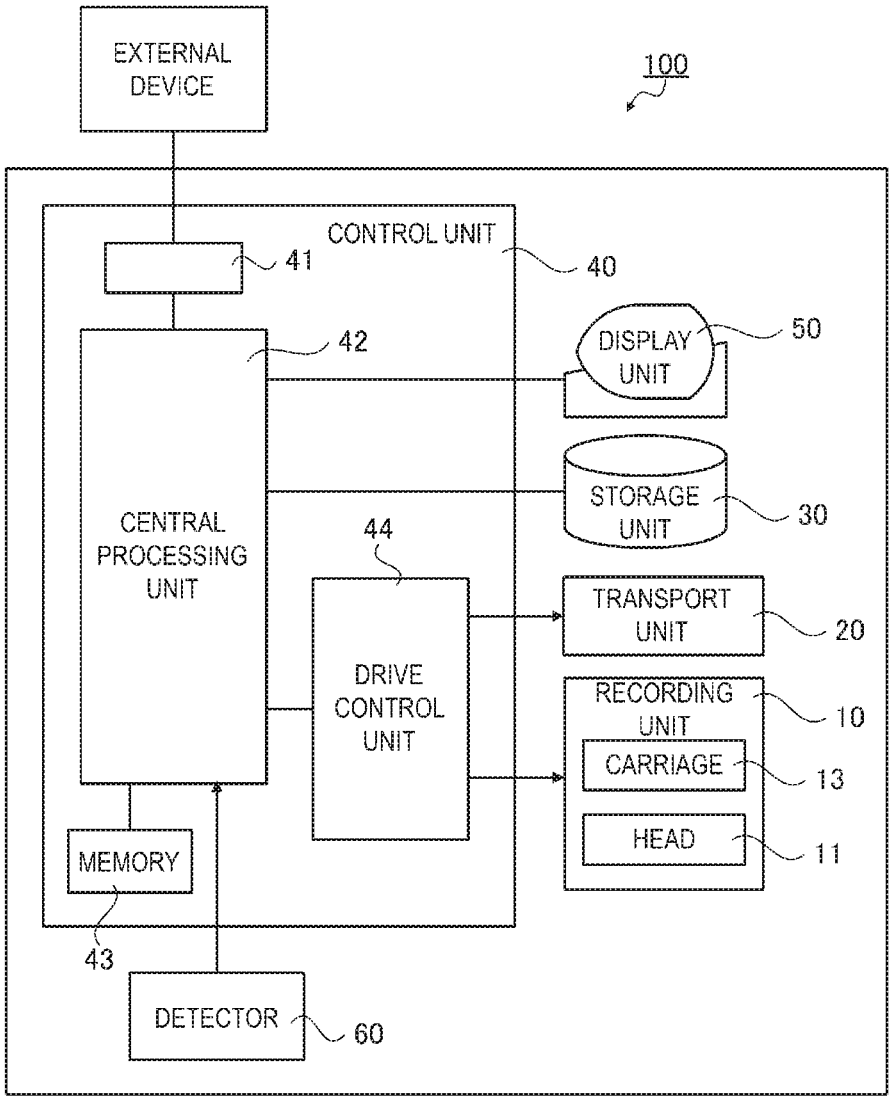
FIG. 2 is a block diagram illustrating an electrical configuration of the ink accommodation device.

As illustrated in FIG. 2, the control unit 40 includes an interface unit 41, a central processing unit 42, a memory 43, and a drive control unit 44. A detector 60 is electrically coupled to the control unit 40.

Figure 3:
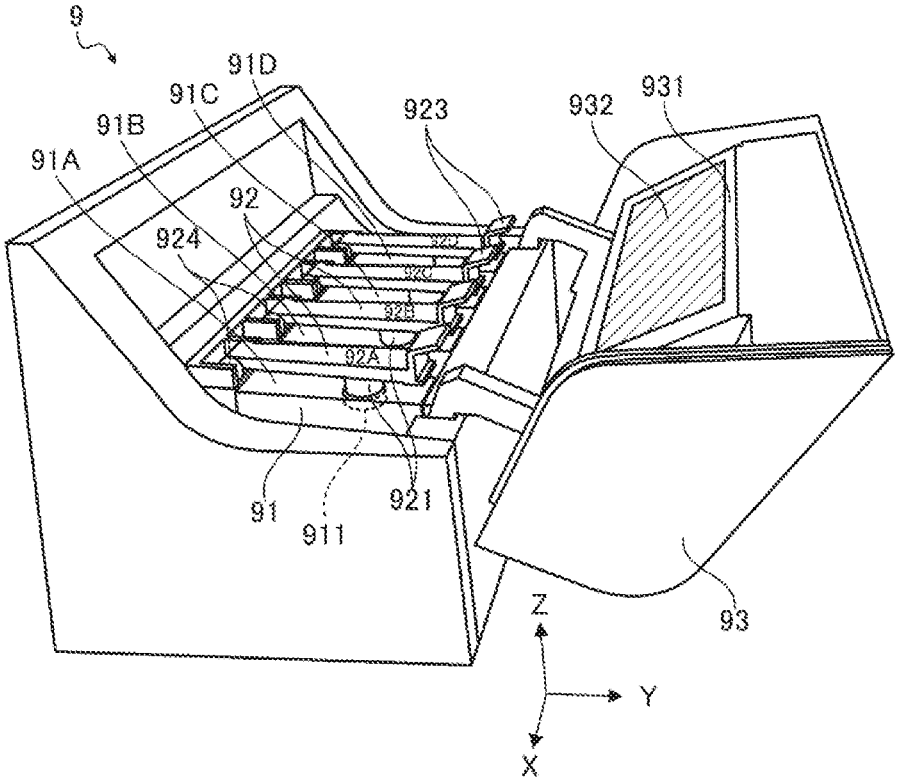
FIG. 3 is a perspective view of an ink accommodation unit.

As illustrated in FIG. 3, the ink accommodation unit 9 includes the ink accommodation bodies 91, and first covers 92 and a second cover 93 as inner covers.

The ink accommodation unit 9 includes, as the ink accommodation bodies 91, a first ink accommodation body 91A, a second ink accommodation body 91B, a third ink accommodation body 91C, and a fourth ink accommodation body 91D. The first accommodation body 91A, the second ink accommodation body 91B, the third ink accommodation body 91C, and the fourth ink accommodation body 91D are aligned in this order with the +X direction as an alignment direction. The first ink accommodation body 91A accommodates the cyan ink composition as the sublimation transfer ink. The second ink accommodation body 91B accommodations the yellow ink composition as the sublimation transfer ink. The third ink accommodation body 91C accommodates the magenta ink composition as the sublimation transfer ink. The fourth ink accommodation body 91D accommodates the black ink composition as the sublimation transfer ink. Note that, a combination of the sublimation transfer inks accommodated in the respective ink accommodation bodies 91 is not limited to the present exemplary embodiment.

An injection port 911 is provided in an upper surface as a first surface of the ink accommodation body 91. In the present exemplary embodiment, an opening direction, that is a direction orthogonal to an opening surface of the injection port 911, is the +Z direction. Note that, the opening surface of the injection port 911 is defined as a virtual flat surface including an edge of the injection port 911.

The first cover 92 has a cap 921 that can close the injection port 911, and a finger-hooking portion 923. The first cover 92 is rotatably supported about a first cover shaft 924. The first cover 92 moves to a closing position at which the cap 921 closes the injection port 911, and to an opening position at which the cap 921 opens the injection port. Note that, the opening position of the first cover 92 is a position at which, when the first cover 92 is at the opening position, the user can inject ink from a bottle accommodating the ink into the ink accommodation body 91 via the injection port 911.

When the first cover 92 moves from the closing position to the opening position, the cap 921 moves relative to the injection port 911 in directions including at least the +Z direction, and separates from the injection port 911. That is, when force in the +Z direction acts on the cap 921, the cap 921 separates from the injection port 911.

In the present exemplary embodiment, as the first covers 92, first covers 92A, 92B, 92C, and 92D are included, and correspond to the first ink accommodation body 91A, the second ink accommodation body 91B, the third ink accommodation body 91C, and the fourth ink accommodation body 91D, respectively. More specifically, the first cover 92A is the first cover 92 having the cap 921 capable of closing the injection port 911 provided in the first ink accommodation body 91A. The first cover 92B is the first cover 92 having the cap 921 capable of closing the injection port 911 provided in the second ink accommodation body 91B. The first cover 92C is the first cover 92 having the cap 921 capable of closing the injection port 911 provided in the third ink accommodation body 91C. The first cover 92D is the first cover 92 having the cap 921 capable of closing the injection port 911 provided in the fourth ink accommodation body 91D.

Below the finger-hooking portion 923 is a gap through which the user can insert a finger. The user can insert the finger into the gap, and press a lower surface of the finger-hooking portion 923 in the +Z direction, to move the first cover 92 from the closing position to the opening position. Note that, at this time, the lower surface of the finger-hooking portion 923 pressed by the user is opposed to the upper surface of the ink accommodation body 91.

With the first cover 92 at the closing position, in a direction along the Y-axis, a distance between the cap 921 and the finger-hooking portion 923 is smaller than a distance between the cap 921 and the first cover shaft 924. In other words, the cap 921 is provided at a position closer to the finger-hooking portion 923 relative to the first cover shaft 924.

The second cover 93 includes a label affixing surface 931 and a label 932 affixed to the label affixing surface 931. The second cover 93 is movable to a cover position for covering the first covers 92. With the cap 921 not closing the injection port 911, and in contact with the edge of the injection port 911, and when the second cover 93 moves to the cover position, the second cover 93 presses the first cover 92, and the first cover 92 is moved to the closing position. In other words, by moving the second cover 93 to the cover position, the cap 921 is inserted into the injection port 911.

Figure 4:
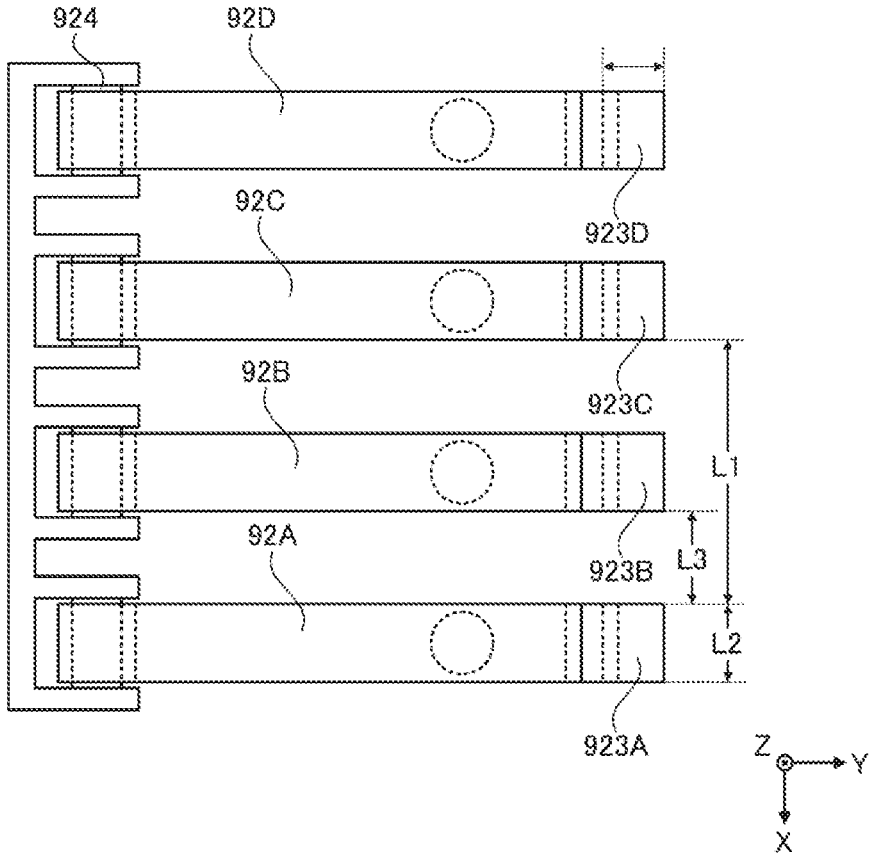
FIG. 4 is a schematic view of a first cover as viewed from above.

As illustrated in FIG. 4, the first covers 92A, 92B, 92C and the 92D are aligned in this order with the +X direction as an alignment direction.

The first cover 92A corresponding to the first ink accommodation body 91A has a first finger-hooking portion 923A as the finger-hooking portion 923. The first cover 92B corresponding to the second ink accommodation body 91B has a second finger-hooking portion 923B as the finger-hooking portion 923. The first cover 92C corresponding to the third ink accommodation body 91C has a third finger-hooking portion 923C as the finger-hooking portion 923. The first cover 92D corresponding to the fourth ink accommodation body 91D has a fourth finger-hooking portion 923D as the finger-hooking portion 923. A distance L1 in the direction along the X-axis between the first finger-hooking portion 923A and the third finger-hooking portion 923C is larger than 25 mm. With this, a sufficient space is ensured for operating the second finger-hooking portion 923B, thus, when the user operates the first cover 92B of the second ink accommodation body 91B, a possibility that the first cover 92A or the first cover 92C is mistakenly operated decreases.

In addition, a distance L3 along the X-axis between the first finger-hooking portion 923A and the second finger-hooking portion 923B is larger than a dimension L2 in the X-axis direction of the first finger-hooking portion 923A. When the finger-hooking portion 923 has a dimension optimized for an operation by the finger, a space around the finger-hooking portion 923 can be utilized to open the first cover 92. Note that, the distance L3 may be larger than 16 mm.

Figure 5:
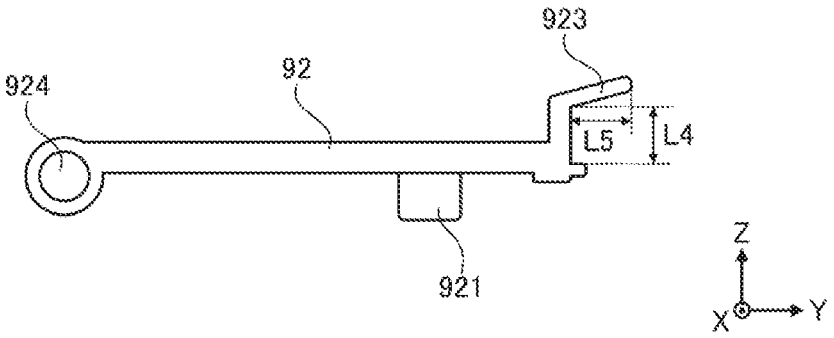
FIG. 5 is a schematic view of the first cover as viewed from a side.

As illustrated in FIG. 5, a gap with a height dimension L4 is provided below the finger-hooking portion 923 of the first cover 92 at the closing position. The dimension L4 may be equal to or larger than 13 mm. Additionally, a dimension L5 of a lower surface of the finger-hooking portion 923 in a Y-axis direction may be equal to or larger than 10 mm.

Hereinafter, technical ideas that are understood from the above exemplary embodiment will be described together with effects.

An ink accommodation device includes an ink accommodation body configured to accommodate a sublimation transfer ink injected, via an injection port, from a bottle accommodating the sublimation transfer ink, and an inner cover having a cap configured to close the injection port, and configured to move between a closing position at which the cap closes the injection port and an opening position at which the cap opens the injection port, wherein the cap is configured to be inserted into and pulled out of the injection port in an opening direction of the injection port when the inner cover moves between the closing position and the opening position, and the inner cover has a finger-hooking portion enabling insertion and pulling of the cap with a finger.

According to this configuration, when injecting the sublimation transfer ink into the accommodation body, the user does not need to grip the cap. Thus, operability of a work for injecting the sublimation transfer ink by the user is improved.

Additionally, an ink accommodation device includes an ink accommodation body configured to accommodate a sublimation transfer ink injected, via an injection port, from a bottle for accommodating the sublimation transfer ink, and an inner cover having a cap configured to close the injection port, and configured to move between a closing position at which the cap closes the injection port and an opening position at which the cap opens the injection port, wherein the cap is configured to be inserted into and pulled out of the injection port in an opening direction of the injection port when the inner cover moves between the closing position and the opening position, and the inner cover has a finger-hooking portion that, in a state in which the inner cover is positioned at the closing position, extends in a direction intersecting the opening direction, and includes a surface opposite, at a predetermined distance, to a first surface, which is provided with the injection port, of the ink accommodation body.

With this configuration, a user can insert a finger between the first surface and the surface included in the finger-hooking portion, and press the surface included in the finger-hooking portion, to move the cap to the opening position, thus when injecting the sublimation transfer ink into the ink accommodation body, the user does not need to grip the cap. Thus, operability of a work for injecting the sublimation transfer ink by the user is improved.

In the above ink accommodation device, the inner cover may rotate about a shaft, and the cap may be positioned between the shaft and the finger-hooking portion.

According to this configuration, displacement of the finger-hooking portion required to separate the cap in a state of being inserted into the injection port from the injection port, and displacement of the finger-hooking portion required to insert the cap in a state of not being inserted into the injection port into the injection port can be reduced. Accordingly, an operation for moving the inner cover by the user is facilitated, and the operability when the sublimation transfer ink is injected is improved.

In the ink accommodation device described above, a configuration may be adopted in which, with a direction that intersects the opening direction of the injection port being an alignment direction, a first ink accommodation body and a second ink accommodation body, which serve as the ink accommodation body, are aligned in this order, and a distance in the alignment direction between a finger-hooking portion of a first inner cover provided in the first ink accommodation body and a finger-hooking portion of a second inner cover provided in the second ink accommodation body is larger than a dimension of the finger-hooking portion of the first inner cover in the alignment direction.

With this configuration, a space between adjacent inner covers is ensured. Thus, the user can insert the finger into the space to operate the inner cover, thereby improving the operability of injecting the sublimation transfer ink.

In the ink accommodation device described above, a configuration may be adopted in which, with a direction that intersects the opening direction of the injection port being the alignment direction, a first ink accommodation body, a second ink accommodation body, and a third ink accommodation body, which serve as the ink accommodation body, are aligned in this order, and a distance in the alignment direction, between the finger-hooking portion of the first inner cover provided in the first ink accommodation body and a finger-hooking portion of a third inner cover provided in the third ink accommodation body is larger than 25 mm.

According to this configuration, a space for working the inner cover sandwiched by two inner covers is ensured, and a possibility that the user mistakenly operates an adjacent inner cover is reduced. Thus, the operability for the user to inject the sublimation transfer ink is improved.

In the ink accommodation device described above, a configuration may be adopted in which, a second cover movable to a cover position for covering the inner cover is included, and by moving the second cover to the cover position, the cap in contact with the injection port is inserted into the injection port.

For a user wearing a glove in particular, a sensation of a fingertip is likely to dull, and the inner cover not at the closing position is mistakenly recognized as being at the closing position in some cases. According to this configuration, the inner cover for which a position is mistakenly recognized is moved to the closing position by movement of the second cover, as far as at least the cap is in contact with the injection port. Thus, the operability for the user to inject the sublimation transfer ink is improved.

What is claimed is:

1. An ink accommodation device, comprising:

an ink accommodation body configured to accommodate a sublimation transfer ink injected, via an injection port, from a bottle accommodating the sublimation transfer ink; and a first inner cover having a cap configured to close the injection port and configured to move between a closing position at which the cap closes the injection port and an opening position at which the cap opens the injection port and a second inner cover configured to move to a cover position covering the first inner cover, wherein the cap is configured to be inserted into and pulled out of the injection port in an opening direction of the injection port when the inner cover moves between the closing position and the opening position, the first inner cover has a finger-hooking portion enabling insertion and pulling of the cap with a finger, and movement of the second inner cover to the cover position moves the first inner cover to insert the cap into the injection port.

2. The ink accommodation device according to claim 1, wherein the first inner cover rotates about a shaft, and the cap is positioned between the shaft and the finger-hooking portion.

3. The ink accommodation device according to claim 1, wherein with a direction that intersects the opening direction of the injection port being an alignment direction, a first ink accommodation body and a second ink accommodation body, which serve as the ink accommodation body, are aligned in this order, and a distance in the alignment direction between a finger-hooking portion of the first inner cover provided in the first ink accommodation body and a finger-hooking portion of the second inner cover provided in the second ink accommodation body is larger than a dimension of the finger-hooking portion of the first inner cover in the alignment direction.

4. The ink accommodation device according to claim 1, wherein with a direction that intersects the opening direction of the injection port being an alignment direction, a first ink accommodation body, a second ink accommodation body, and a third ink accommodation body, which serve as the ink accommodation body, are aligned in this order, and a distance in the alignment direction between the finger-hooking portion of the first inner cover provided in the first ink accommodation body and a finger-hooking portion of a third inner cover provided in the third ink accommodation body is larger than 25 mm.

5. The ink accommodation device according to claim 1, the finger-hook portion comprises a protruding portion; and a first gap between a first point of the protruding portion and the first surface of the ink accommodation body is longer than a second gap between a second point of the protruding portion, nearer to the shaft than the first point, and the first surface of the ink accommodation body.

6. The ink accommodation device according to claim 1, when the second cover moves to the cover position, the second cover presses the inner cover, and the cap is inserted into the injection port.

7. The ink accommodation device according to claim 1, the finger-hook portion comprises a gap formed between a first upper protruding portion and a second lower protruding portion of the finger-hook portion, the first upper protruding portion and the second lower protruding portion, in a state in which the inner cover is positioned at the closing position, extending in a direction intersecting the opening direction, the second lower protruding portion extending less than the first upper protruding portion.

8. An ink accommodation device, comprising:

an ink accommodation body configured to accommodate a sublimation transfer ink injected, via an injection port, from a bottle accommodating the sublimation transfer ink; and a first inner cover having a cap configured to close the injection port and configured to move between a closing position at which the cap closes the injection port and an opening position at which the cap opens the injection port and a second inner cover configured to move to a cover position covering the first inner cover, wherein the cap is configured to be inserted into and pulled out of the injection port in an opening direction of the injection port when the first inner cover moves between the closing position and the opening position, the inner cover has a finger-hooking portion that, in a state in which the first inner cover is positioned at the closing position, extends in a direction intersecting the opening direction and includes a surface opposite, at a predetermined distance, to a first surface, which is provided with the injection port, of the ink accommodation body, and movement of the second inner cover to the cover position moves the first inner cover to insert the cap into the injection port.

9. The ink accommodation device according to claim 8, the finger-hook portion comprises a protruding portion; and a first gap between a first point of the protruding portion and the first surface of the ink accommodation body is longer than a second gap between a second point of the protruding portion, nearer to the shaft than the first point, and the first surface of the ink accommodation body.

10. The ink accommodation device according to claim 8, when the second cover moves to the cover position, the second cover presses the inner cover, and the cap is inserted into the injection port.

11. The ink accommodation device according to claim 8, the finger-hook portion comprises a gap formed between a first upper protruding portion and a second lower protruding portion of the finger-hook portion, the first upper protruding portion and the second lower protruding portion, in a state in which the inner cover is positioned at the closing position, extending in a direction intersecting the opening direction, the second lower protruding portion extending less than the first upper protruding portion.

* * * * *